US007976185B2

(12) United States Patent
Uang et al.

(10) Patent No.: US 7,976,185 B2
(45) Date of Patent: Jul. 12, 2011

(54) LIGHT EMITTING DIODE LAMP TUBE

(75) Inventors: Chii-Maw Uang, Kaohsiung County (TW); Huei-Ting Ku, Kaohsiung County (TW)

(73) Assignee: I Shou University, Kaohsiung (TW)

( * ) Notice: Subject to any disclaimer, the term of this patent is extended or adjusted under 35 U.S.C. 154(b) by 235 days.

(21) Appl. No.: 12/501,118

(22) Filed: Jul. 10, 2009

(65) Prior Publication Data

US 2010/0067230 A1 Mar. 18, 2010

(30) Foreign Application Priority Data

Sep. 17, 2008 (TW) ..... 97135621 A

(51) Int. Cl.
*F21V 11/00* (2006.01)
*H01J 1/62* (2006.01)

(52) U.S. Cl. ..... 362/240; 362/311.02; 313/512

(58) Field of Classification Search ..... 362/240, 362/235, 249.01, 249.02, 249.06, 217.01, 362/217.02, 246, 311.01, 311.02; 313/512, 313/493, 498, 634; 315/152
See application file for complete search history.

(56) References Cited

U.S. PATENT DOCUMENTS

| | | | | |
|---|---|---|---|---|
| 4,991,070 | A * | 2/1991 | Stob | 362/223 |
| 6,283,612 | B1 * | 9/2001 | Hunter | 362/240 |
| 6,860,628 | B2 * | 3/2005 | Robertson et al. | 362/555 |
| 7,476,004 | B2 * | 1/2009 | Chan | 362/240 |
| 7,611,260 | B1 * | 11/2009 | Lin et al. | 362/224 |
| 2005/0122742 | A1 * | 6/2005 | Ho | 362/615 |
| 2010/0079075 | A1 * | 4/2010 | Son | 315/152 |
| 2010/0102729 | A1 * | 4/2010 | Katzir et al. | 315/113 |

* cited by examiner

*Primary Examiner* — John A Ward
(74) *Attorney, Agent, or Firm* — Fox Rothschild, LLP; Robert J. Sacco

(57) ABSTRACT

A light emitting diode (LED) lamp tube includes a lamp device including a circuit board, and a plurality of LEDs mounted on the circuit board. The circuit board is disposed in a tubular enclosure such that an inner peripheral surface of the enclosure is divided into a non-illuminated portion and a light-receiving portion. The tubular enclosure has a plurality of tapered protrusions extending from the light-receiving portion toward the LEDs. Each of the tapered protrusions converges from the light-receiving portion toward the LEDs. Each of the tapered protrusions further has a maximum width at an outer end thereof, which increases gradually from a middle portion of the light-receiving portion toward junctions of the light-receiving portion and the non-illuminated portion.

3 Claims, 5 Drawing Sheets

LIGHT EMITTING DIODE LAMP TUBE

CROSS-REFERENCE TO RELATED APPLICATION

This application claims priority of Taiwanese Application No. 097135621, filed on Sep. 17, 2008.

BACKGROUND OF THE INVENTION

1. Field of the Invention

The invention relates to a light emitting diode (LED) lamp tube, more particularly to a lamp tube capable of providing uniform illumination and preventing glare.

2. Description of the Related Art

Conventional light emitting diode (LED) lamp tubes have a longer service life than fluorescent lamps and can replace the fluorescent lamps. Referring to FIG. 1, a conventional LED lamp tube 1 comprises a lamp device 11 and a tubular enclosure 12. The lamp device 11 includes a circuit board 111 disposed in the enclosure 12, a plurality of LEDs 112 electrically connected to the circuit board 111, and two electrode seats 113 electrically connected to the LEDs 112. The circuit board 111 divides an inner surface of the tubular enclosure 12 into a light-receiving portion and a non-illuminated portion.

However, the conventional LED lamp tubes encounter a problem during use in that glare is generated that can irritate users' eyes and make the users uncomfortable and dizzy due to the fact that the number of beams of light passing through the light-receiving portion of the tubular enclosure 12 reduces gradually from a middle portion of the light-receiving portion to junctions between the light-receiving portion and the non-illuminated portion. In particular, as illustrated in FIG. 2, with respect to an axial position of the lamp tube 1, the brightness of regions (b) is greater than that of each region (a), and smaller than that of region (c). As such, the brightness of the light-receiving portion of the tubular enclosure 12 is not uniform, and glare is generated.

In order to alleviate the above drawbacks, Taiwanese Patent Publication No. 330422 discloses an improved LED lamp tube. Referring to FIG. 3, the main difference between the improved LED lamp tube and the previously described LED lamp tube 1 resides in the configuration of the tubular enclosure. In the improved LED lamp tube, a plurality of transparent protrusions 121 are formed on an inner peripheral surface of the enclosure 12. Light emitted by the LEDs 112 is refracted in the protrusions 121 to redirect the light, thus reducing glare. However, the improved LED lamp tube cannot increase effectively uniformity of illumination. That is, the LED lamp is brighter at a middle portion of the light-receiving portion of the lamp tube, and darker at junctions of the light-receiving portion and the non-illuminated portion.

SUMMARY OF THE INVENTION

Therefore, the object of the present invention is to provide a light emitting diode lamp tube that can provide uniform illumination.

According to the present invention, there is provided a light emitting diode (LED) lamp tube comprising a lamp device including a circuit board, a plurality of LEDs mounted on the circuit board and electrically connected to the circuit board, and two electrode seats adapted to be electrically connected to a power source and being electrically connected to the circuit board. A tubular enclosure includes an inner peripheral surface. The circuit board is disposed in the tubular enclosure such that the inner peripheral surface of the enclosure is divided into a non-illuminated portion and a light-receiving portion that is positioned for receiving light emitted by the LEDs. The tubular enclosure further includes a plurality of tapered protrusions extending from the light-receiving portion toward the LEDs. Each of the tapered protrusions converges from the light-receiving portion toward the LEDs, and has a pointed inner end distal from the light-receiving portion, and an outer end proximate to the light-receiving portion. Each of the tapered protrusions further has a maximum width at the outer end thereof, which increases gradually from a middle portion of the light-receiving portion toward junctions of the light-receiving portion and the non-illuminated portion.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
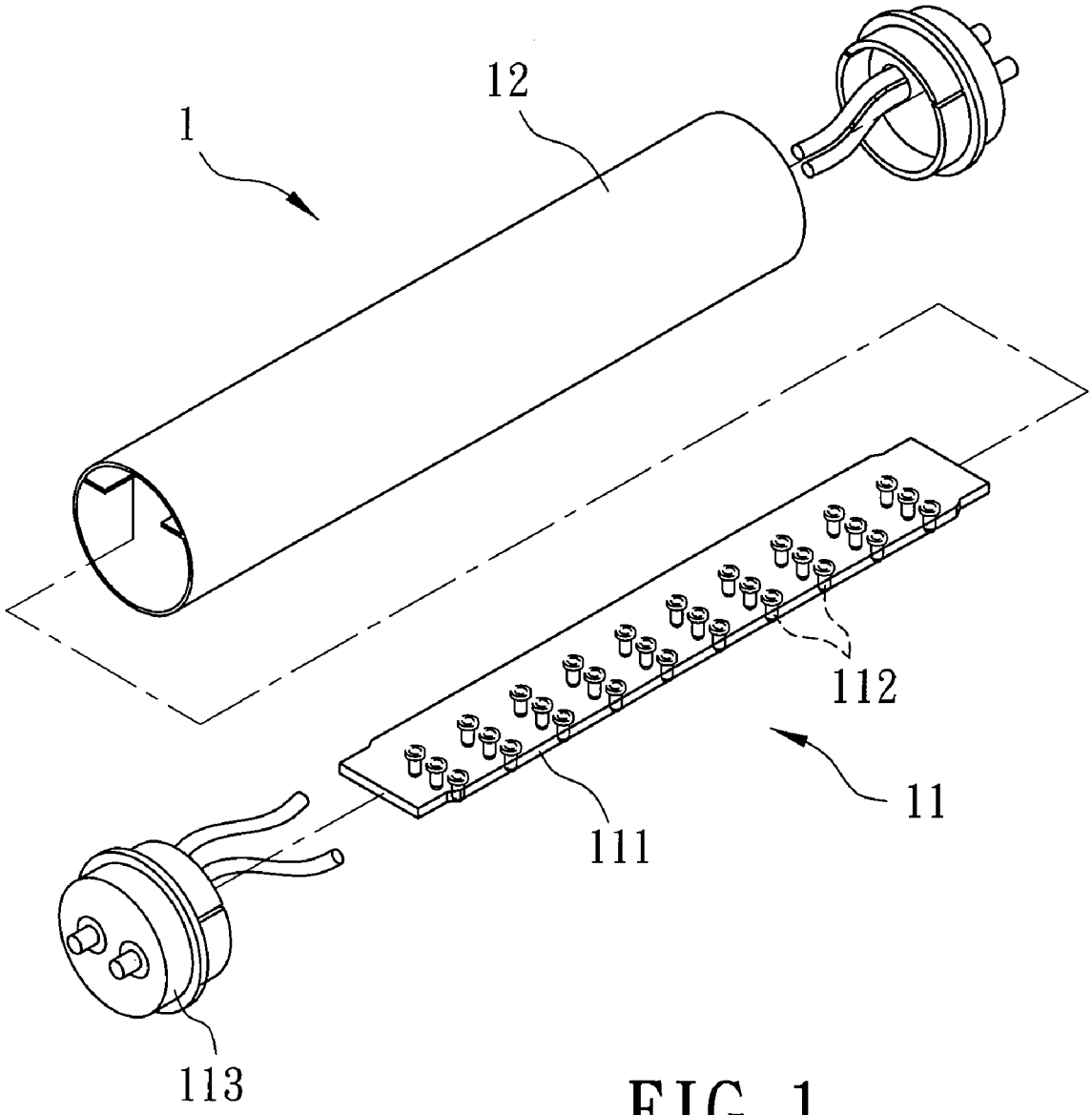
FIG. 1 PRIOR ART
FIG. 1 is a partly exploded perspective view showing a conventional light emitting diode (LED) lamp tube.
Figure 2:
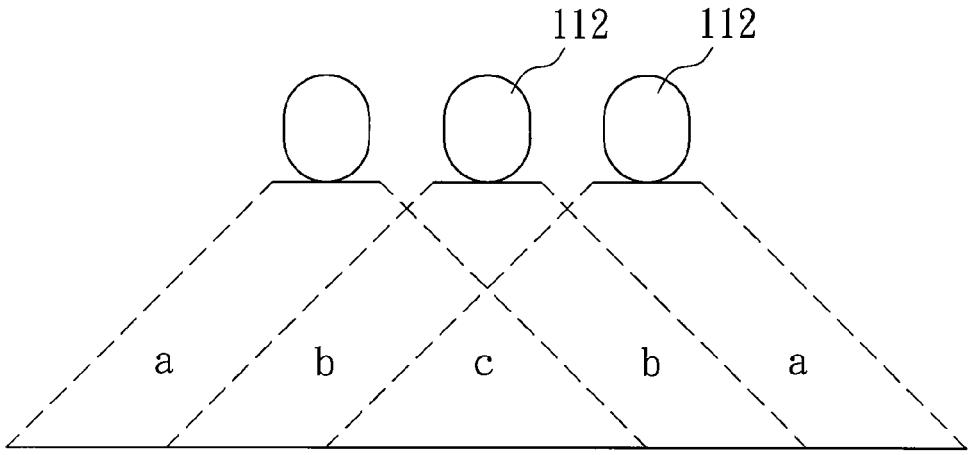
FIG. 2 PRIOR ART
FIG. 2 is a schematic view illustrating non-uniform illumination of the conventional LED lamp tube.
Figure 3:
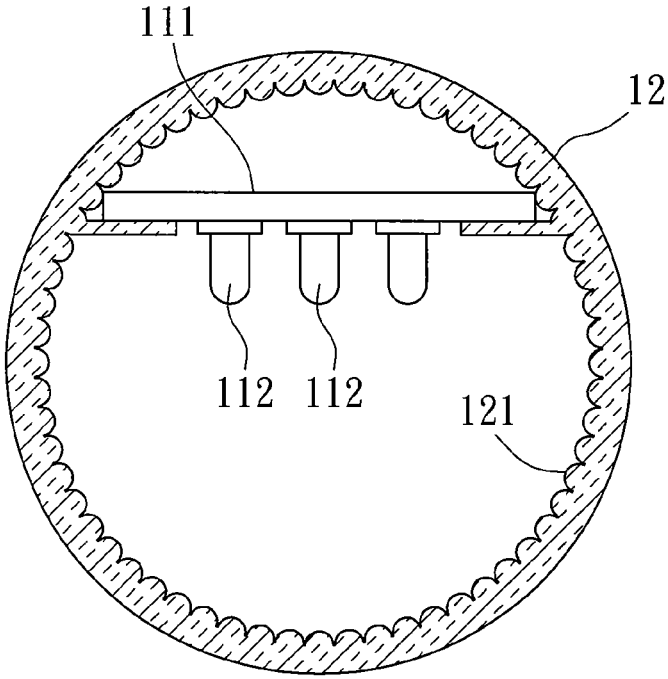
FIG. 3 PRIOR ART
FIG. 3 is a partly sectional view of an LED lamp tube disclosed in Taiwanese Publication No. 330422.

Before the present invention is described in greater detail, it should be noted that like elements are denoted by the same reference numerals throughout the disclosure.

Figure 4:
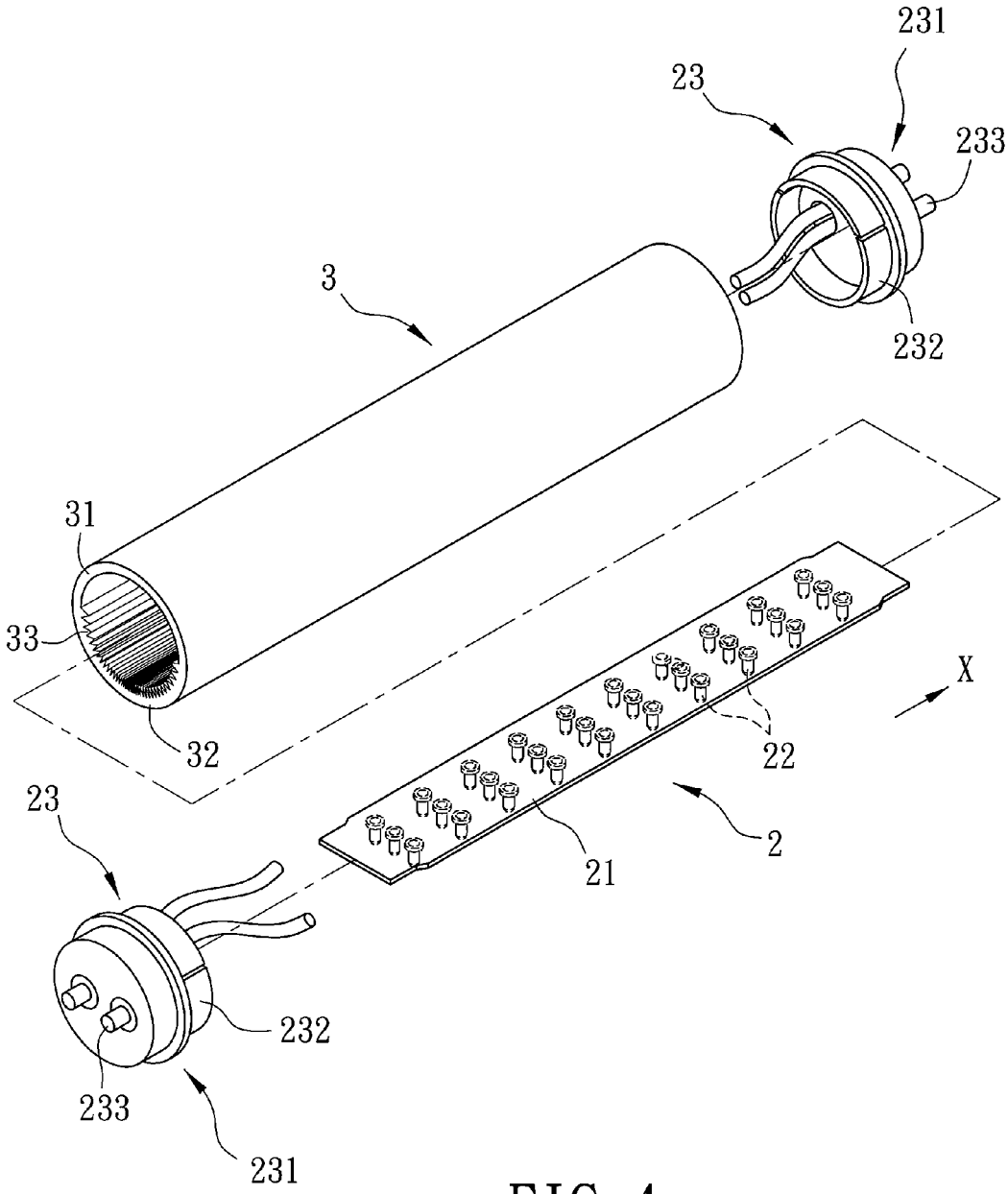
FIG. 4 is a partly exploded perspective view of a first preferred embodiment of an LED lamp tube according to the present invention.

Referring to FIG. 4, a light emitting diode (LED) lamp tube of a first preferred embodiment of the present invention comprises a lamp device 2 and a tubular enclosure 3. The lamp device 2 includes a circuit board 21, a plurality of LEDs 22 mounted on the circuit board 21 and electrically connected to the circuit board 21, and two electrode seats 23 adapted to be electrically connected to a power source and electrically connected to the circuit board 21.

Each of the electrode seats 23 includes a connector 231, a circuit board retaining portion 232, and two electrodes 233 electrically connected to the circuit board 21.

The tubular enclosure 3 extends along an axial direction (X), and includes an inner peripheral surface. The circuit board 21 is disposed in the tubular enclosure 3 such that the inner peripheral surface of the enclosure 3 is divided into a non-illuminated portion 31 and a light-receiving portion 32 that is positioned for receiving light emitted by the LEDs 22.

Figure 5:
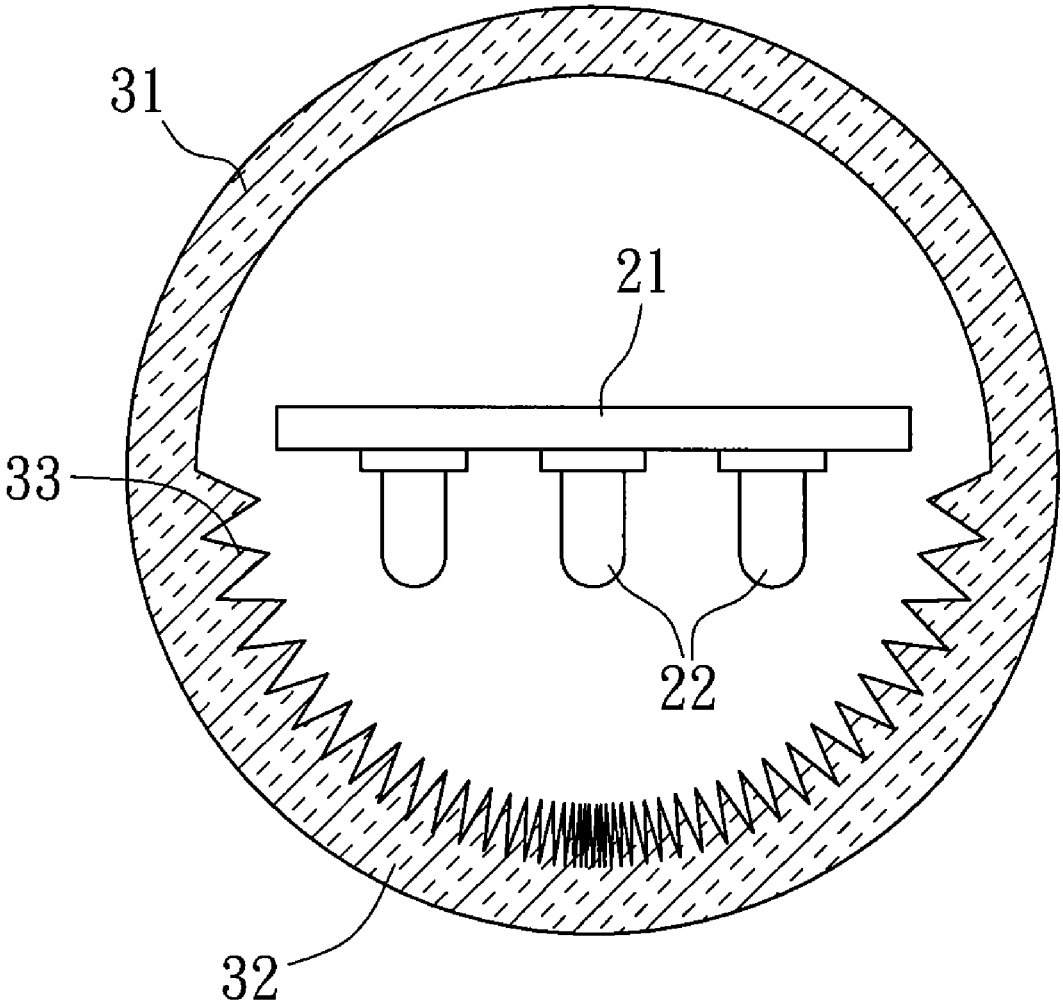
FIG. 5 is a partly sectional view of the LED lamp tube of the first preferred embodiment.
Figure 6:
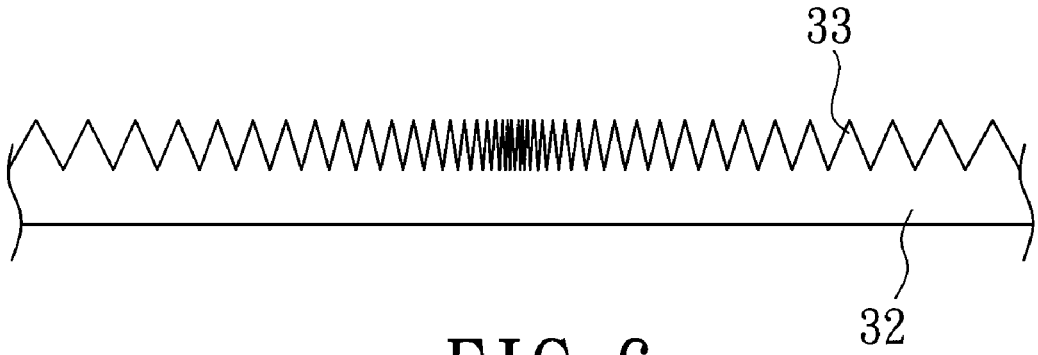
FIG. 6 is a schematic view of a tubular enclosure of the first preferred embodiment when laid flat on a plane.

Referring to FIGS. 5 and 6, the tubular enclosure 3 further includes a plurality of tapered protrusions 33 extending from the light-receiving portion 32 toward the LEDs 22. Each of the tapered protrusions 33 converges from the light-receiving portion 32 toward the LEDs 22, and has a pointed inner end distal from the light-receiving portion 32, and an outer end proximate to the light-receiving portion 32. Each of the tapered protrusions 33 further has a maximum width at the outer end thereof, which increases gradually from a middle portion of the light-receiving portion 32 toward junctions of the light-receiving portion 32 and the non-illuminated portion 31. In this embodiment, each of the protrusions 33 has a cross-section that is shaped as an isosceles triangle.

Light emitted by the LEDs 22 is transmitted into and refracted in the protrusions 33. The refraction angle of each light beam emitted by each of the LEDs 22 and into the tubular enclosure 3 is larger than the incident angle of the same, so that the refracted light beams are redirected and condensed gradually from the middle portion of the light-receiving portion 32 toward the junctions of the light-receiving portion 32 and the non-illuminated portion 31. Hence, uniform illumination is achieved, and glare is prevented.

Figure 7:
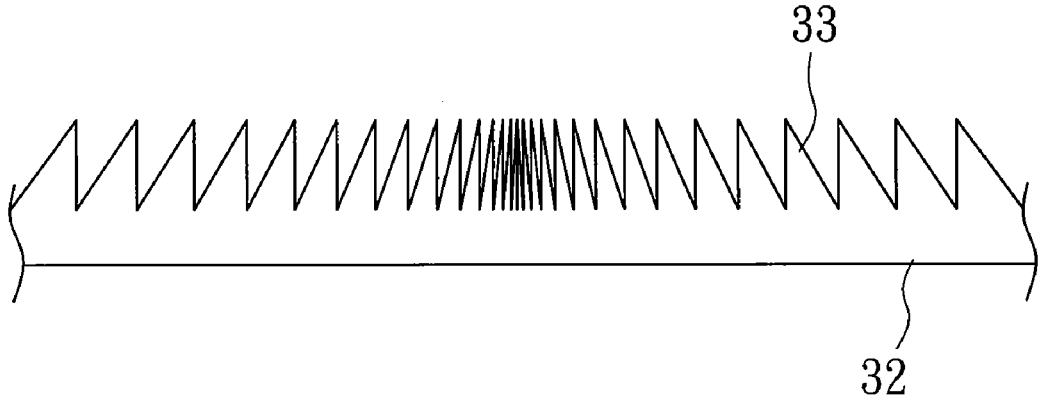
FIG. 7 is a schematic view of a tubular enclosure of an LED lamp tube of a second preferred embodiment of this invention when laid flat on a plane.

Referring to FIG. 7, a second preferred embodiment of the LED lamp tube according to the present invention has a structure similar to that of the first embodiment. The main difference between the second embodiment and the first embodiment resides in the configuration of the tapered protrusions 33. In the second preferred embodiment, each of the protrusions 33 has a cross-section that is shaped as a right-angled triangle. The second preferred embodiment has the same advantages as those of the first preferred embodiment.

To sum up, due to the configuration of the tapered protrusions 33 of the LED lamp tube according to the present invention, light beams emitted by the LEDs 22 are refracted and redirected to provide uniform illumination.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A light emitting diode (LED) lamp tube comprising:

a lamp device including a circuit board, a plurality of LEDs mounted on said circuit board and electrically connected to said circuit board, and two electrode seats adapted to be electrically connected to a power source and electrically connected to said circuit board; and a tubular enclosure including an inner peripheral surface, said circuit board being disposed in said tubular enclosure such that said inner peripheral surface of said enclosure is divided into a non-illuminated portion and a light-receiving portion that is positioned for receiving light emitted by said LEDs, said tubular enclosure further including a plurality of tapered protrusions extending from said light-receiving portion toward said LEDs, each of said tapered protrusions converging from said light-receiving portion toward said LEDs and having a pointed inner end distal from said light-receiving portion, and an outer end proximate to said light-receiving portion, each of said tapered protrusions further having a maximum width at said outer end thereof, which increases gradually from a middle portion of said light-receiving portion toward junctions of said light-receiving portion and said non-illuminated portion.

2. The LED lamp tube as claimed in claim 1, wherein each of said protrusions has a cross-section that is shaped as an isosceles triangle.

3. The LED lamp tube as claimed in claim 1, wherein each of said protrusions has a cross-section that is shaped as a right-angled triangle.

* * * * *